US007032833B2

(12) United States Patent
Böcking

(10) Patent No.: US 7,032,833 B2
(45) Date of Patent: Apr. 25, 2006

(54) FUEL INJECTION VALVE

(75) Inventor: Friedrich Böcking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 153 days.

(21) Appl. No.: 10/433,346

(22) PCT Filed: Sep. 7, 2002

(86) PCT No.: PCT/DE02/03336

§ 371 (c)(1),
(2), (4) Date: Nov. 5, 2003

(87) PCT Pub. No.: WO03/033905

PCT Pub. Date: Apr. 24, 2003

(65) Prior Publication Data

US 2004/0061003 A1 Apr. 1, 2004

(30) Foreign Application Priority Data

Oct. 10, 2001 (DE) ..... 101 49 915

(51) Int. Cl.
*F02M 47/02* (2006.01)

(52) U.S. Cl. ..... 239/102.2; 239/88; 239/533.2; 239/89; 251/129.06; 123/498

(58) Field of Classification Search ..... 239/102.1, 239/102.2, 88, 89, 90, 533.2, 533.3, 533.9; 251/129.06; 137/468; 123/498; 310/327, 310/326

See application file for complete search history.

(56) References Cited

U.S. PATENT DOCUMENTS

| | | | | |
|---|---|---|---|---|
| 4,284,263 | A * | 8/1981 | Newcomb | 251/129.06 |
| 4,550,744 | A * | 11/1985 | Igashira et al. | 137/80 |
| 4,958,101 | A * | 9/1990 | Takahashi et al. | 310/328 |
| 6,313,568 | B1 * | 11/2001 | Sullivan et al. | 310/346 |

FOREIGN PATENT DOCUMENTS

| | | |
|---|---|---|
| DE | 195 38 791 | 4/1997 |
| DE | 199 28 183 | 1/2001 |
| DE | 199 28 185 | 1/2001 |
| DE | 199 48 359 | 1/2001 |
| EP | 0 869 278 | 10/1998 |
| EP | 1 079 101 | 2/2001 |

* cited by examiner

*Primary Examiner*—Dinh Q. Nguyen
(74) *Attorney, Agent, or Firm*—Kenyon & Kenyon

(57) ABSTRACT

In a fuel injector, in particular a fuel injector for fuel-injection systems of internal combustion engines, a piezoelectric or magnetostrictive actuator is surrounded by a compensation sleeve. The compensation sleeve is made of a material exhibiting virtually no, or negative, thermal expansion, so that the thermal expansion of the compensation sleeve and that of an upper valve-body section and/or lower valve-body section essentially corresponds to the thermal expansion of the actuator and effective transmission elements to the valve-sealing seat. The compensation sleeve, radially on the outside, is enclosed by a spring sleeve, which connects the lower valve-body section to the upper valve-body section and prestresses the compensation sleeve for pressure.

5 Claims, 1 Drawing Sheet

FUEL INJECTION VALVE

BACKGROUND INFORMATION

From German Patent Application No. DE 195 38 791, a fuel injector for fuel-injection systems of internal combustion engines is known which has a piezoelectric device guided in a valve member whose piezoactuator, which cooperates with a needle-type valve-closure member, is fixedly clamped in an end piece facing away from the closure member and, upon activation, lifts the valve-closure member off from a valve seat. The end piece is fixedly connected to the valve member tightly surrounding the piezoactuator. The valve member is made of a material that compensates for the temperature-related longitudinal changes of the piezoactuator at least approximately.

In one embodiment, a fuel injector is known from German Patent Application No. DE 195 38 791 whose valve body is embodied as a two-part sleeve, which has sleeve parts that are arranged coaxially with respect to one another. These sleeve parts are situated in such a way that they follow each other in an imaginary longitudinal direction of the fuel injector and are made of materials having different thermal expansion coefficients, the materials being steel and Invar, for example. The sum of the temperature-related expansions of these two sleeve parts corresponds to the temperature-related expansion of the piezoactuator and of connection elements to the valve-closure member.

Disadvantageous in this known related art is that the sleeve, which has very low thermal expansion or none at all and is made of an expensive material, must fulfill all the functions of a valve member as well. Thus, the sleeve is not only subjected to a pressure load, but to a tensile load as well and must therefore be appropriately manufactured and include affixation means. This means that threads or similar devices must be provided, and increased material is required since these affixation means take up unit volume. Furthermore, it is disadvantageous that the sleeve must be redesigned when the overall length or the material properties of the actuator are changed even slightly, since it is solely the effective length of the sleeve that determines the measure of the thermal overall expansion.

From European Patent Application No. EP 0 869 278, a fuel injector having a controllable actuator is known, which is inserted in an actuator housing fixedly connected to a valve body. The actuator is in operative connection with a valve needle, and a valve-closure member, which cooperates with a valve-seat surface to form a valve-sealing seat, is formed on the valve needle. The material of the actuator housing has a thermal expansion coefficient which is nearly equal to the thermal expansion coefficient of the piezoelectric actuator. The actuator housing is inserted in a recess of the valve body and screw fitted with the valve body via a flange situated approximately in the middle of the longitudinal extension of the actuator housing. The temperature-related expansion of the actuator and the transmission elements up to the valve-closure member corresponds to the temperature-related expansion of the valve body and of the segment of the actuator housing running from the flange up to an end element on which the actuator is braced.

Disadvantageous in the indicated related art is that it offers no way to avoid having to form the actuator-housing attachment on the valve member in the material having low thermal expansion. Producing a flange, for example, requires a blank in the manufacture, the blank having at least the diameter of the flange, thus causing considerable material waste. Because of the special material, this is very expensive.

Moreover, here, too, it is disadvantageous that no provision is made for precise regulation, and a change in the dimensions or properties of the actuator requires a new design and a modification of the component of the actuator housing.

SUMMARY OF THE INVENTION

The fuel injector of the present invention has the advantage over the related art that the thermal expansion is able to be adjusted more precisely by the prestressing of the spring sleeve. Due to the prestressing, the thermal expansion may be influenced to a slight degree and adjusted more precisely to the thermal expansion of the actuator. Moreover, it is advantageous that the compensation section is not subjected to a tensile load and may thus have a less complicated design. Therefore, the material requirement with respect to materials having no, or only negative, thermal expansion is reduced, resulting in considerable cost savings since these materials are quite expensive. The compensation section is retained solely by the clamping between the upper valve-body section and lower valve-body section and requires no unit volume and no machining for connections, such as threaded bores.

The spring sleeve may be embodied as a tube spring. In this manner, a spring sleeve having a spring constant in the direction of the longitudinal axis of the spring sleeve may be effected in an advantageous manner. The tube spring is characterized by slots in the sleeve, which are arranged in radial planes, the webs between the slots meeting a slot in the adjacent radial plane.

Advantageously, the tube spring is screw-fitted to the lower valve-body section and surrounds the upper valve-body section at a flange. Owing to the thread, the prestress is able to be adjusted very precisely and in a simple manner, especially when using a fine thread.

The tube spring may be made of Invar. When the tube spring is made of Invar, i.e., a nickel/iron alloy, a reduction in the initial stress in response to a temperature increase is avoided.

In an advantageous design, the compensation section is made of Invar. Invar has a very low thermal expansion coefficient, which is near zero, so that it is easy to determine the overall thermal expansion since the compensation section does not exhibit thermal expansion. The thermal expansion is determined solely by the effective overall length of the upper valve-body section and the lower valve-body section.

The compensation section may have the form of a cylinder with surface-ground end faces. In this way, the compensation section is able to be manufactured in an inexpensive manner from a semi-finished product. The sealing may be achieved by surface-ground areas, which require no additional formations for sealing means, such as an o-ring.

DETAILED DESCRIPTION

Figure 1:
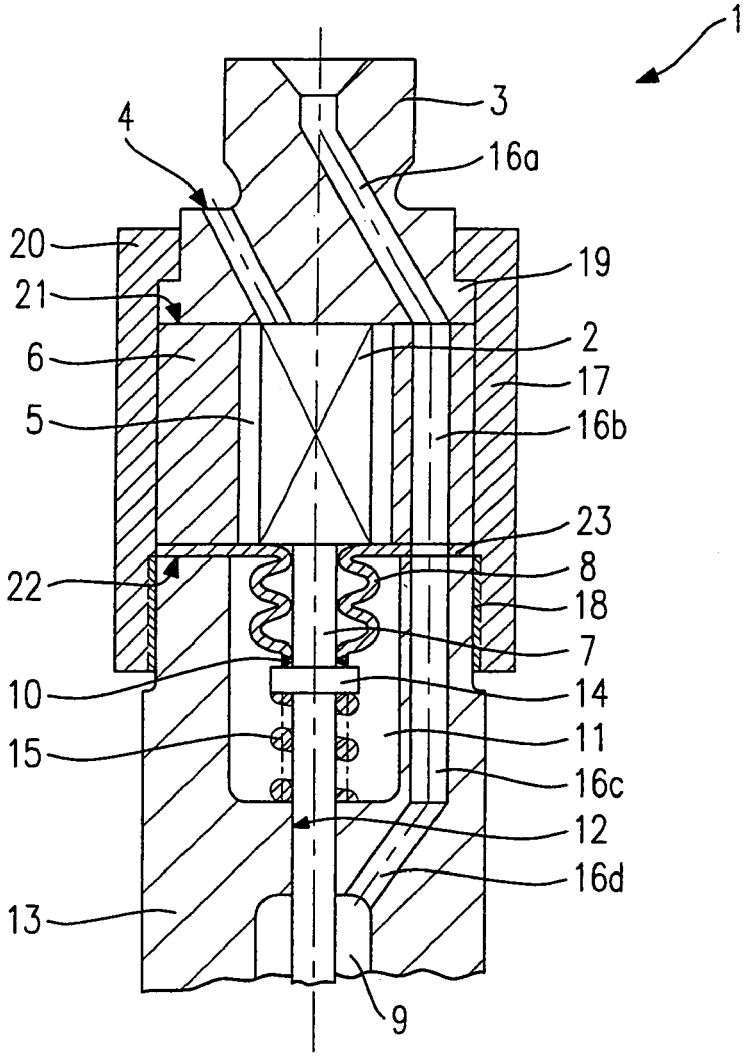
FIG. 1 shows a schematic part-sectional view through an exemplary embodiment of a fuel injector configured according to the present invention.

FIG. 1 shows a schematic section through an exemplary embodiment of a fuel injector 1 configured according to the present invention. An actuator 2 is braced against an upper valve-body section 3 and is controlled via a connecting bore 4 in upper valve-body section 3 by way of connecting lines (not shown here). Actuator 2 is located in an actuator chamber 5, which, radially toward the outside, is bounded by a compensation sleeve 6. Actuator 2 transmits a lifting movement to a valve needle 9 via an actuator tappet 7. Affixed on actuator 7, via a welded seam 10, is a corrugated tube 8, which seals actuator chamber 5 from a fuel chamber 11. Valve needle 9 is joined to a valve-closure member (not shown here), which cooperates with a valve-seat surface to form a valve-sealing seat. A guide bore 12 in a lower valve-body section 13 guides valve needle 9.

At its end facing actuator tappet 7, valve needle 9 has a flange 14 against which a valve spring 15 abuts, valve spring 15 being supported by the lower valve-body section 13. In fuel injector 1 shown here, which has an outwardly opening valve needle 9, valve spring 15 presses valve needle 9 in the direction of actuator 2. The fuel is conveyed to the valve-sealing seat (not shown here) via an inflow bore 16*a* in upper valve-body section 3, an inflow bore 16*b* in the compensation sleeve, an inflow bore 16*c* and an additional inflow bore 16*d*, both in lower valve-body section 13.

Compensation sleeve 6 is surrounded by a spring sleeve 17 radially on the outside. Spring sleeve 17 is connected to lower valve-body section 13 via a thread 18. Upper valve-body section 3 has a flange 19 around which a bend 20 of spring sleeve 17 wraps. Compensation sleeve 6 has a face-ground surface 21 at its interface with the upper valve-body section. Furthermore, compensation sleeve 6 includes an additional face-ground surface 22, which, via a radial clamping surface 25 of corrugated tube 8, abuts against lower valve-body section 13. Spring sleeve 17 is threaded onto thread 18 until it expands and exerts a prestressing force upon compensation sleeve 6.

Figure 2:
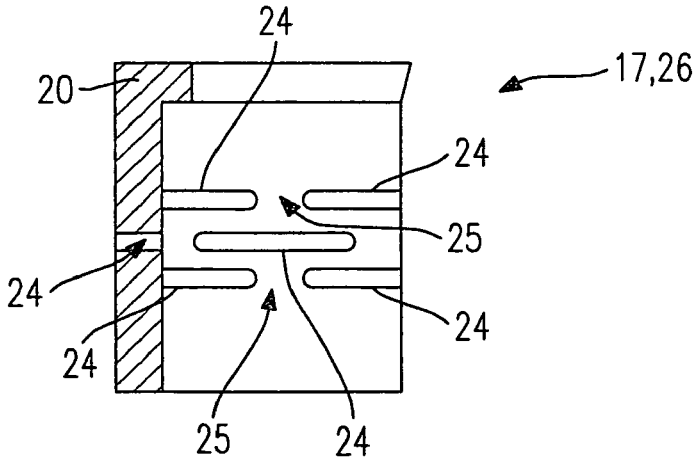
FIG. 2 shows a schematic part-sectional view through the tube spring of the fuel injector in FIG. 1.

FIG. 2 shows a schematic part-sectional view through spring sleeve 17 of fuel injector 1 in FIG. 1. Spring sleeve 17 is embodied as tube spring 26, slots 24 being arranged in radial planes. Remaining material webs 25 between slots 24 meet a slot 24 in the next radial plane. At the upper end of tube spring 17 is bend 20, which wraps around flange 19 of the upper valve-body section.

If actuator 2 is controlled by an electric voltage, it transmits a lift to actuator tappet 7, which in turn transmits the movement to valve needle 9. In the process, corrugated tube 8, deforming elastically, follows this lift movement and seals actuator chamber 5. The valve-sealing seat (not shown) opens and fuel is injected into a combustion chamber. Once the voltage drops, valve spring 15 presses valve needle 9 back into its original position and simultaneously compresses actuator 2 to its original length via actuator tappet 7.

In the temperature increase that occurs in the course of the operational life of fuel injector 1, valve needle 9, actuator tappet 7 and actuator 2 expand or change their length, which means that the length of the components actuator 2, actuator tappet 7 and valve needle 9, which is decisive for a lift of valve needle 9, changes up to the valve-sealing seat. At the same time, the length of lower valve-body section 13, from the valve-sealing seat via (to) compensation sleeve 6, changes as well. If the length of compensation 6 is such that the thermal expansion of the two described successive components is essentially identical, the thermal expansion is compensated. The thermal expansion of compensation sleeve 6 is able to be influenced further in this context, at least to a slight extent, by the prestressing of spring sleeve 17.

The described fuel injector 1 according to the present invention requires only small quantities of special materials, such as the alloy Invar, for the manufacture of compensation sleeve 6, since this compensation sleeve 6 is only subjected to pressure and designed as a simple cylinder sleeve having two planar surfaces. Due to planar surfaces 21, 22, sealing may be achieved in a simple manner. Compensation sleeve 6 may, in particular, be manufactured from an endless semifinished material, especially suitable tubing, and there will be virtually no material loss within the framework of manufacture.

What is claimed is:

1. A fuel injector for a fuel-injection system of an internal combustion engine comprising:

a valve-seat surface;

a valve-closure member cooperating with the valve-seat surface to form a valve-sealing seat;

a valve needle connected to the valve-closure member;

an actuator for actuating the valve needle and the valve-closure member, the actuator being one of piezoelectric and magnetostrictive;

an upper valve-body section;

a lower valve-body section;

effective transmission elements;

a compensation sleeve surrounding the actuator, the compensation sleeve being composed of a material having substantially no, or negative, thermal expansion, so that a thermal expansion of the compensation sleeve and of at least one of the upper valve-body section and the lower valve-body section substantially corresponds to a thermal expansion of the actuator and the effective transmission elements to the valve-sealing seat; and a spring sleeve enclosing the compensation sleeve radially on an outside, the spring sleeve connecting the lower valve-body section to the upper valve-body section and prestressing the compensation sleeve for pressure;

wherein the spring sleeve includes a tube spring.

2. The fuel injector according to claim 1, further comprising:

a thread joining the tube spring to the lower valve-body section; and a flange at which the tube spring wraps around the upper valve-body section.

3. The fuel injector according to claim 1, wherein the tube spring is composed of Invar.

4. The fuel injector according to claim 1, wherein the compensation sleeve is composed of Invar.

5. The fuel injector according to claim 1, wherein the compensation sleeve has the shape of a cylinder with face-ground end faces.

* * * * *